US005387361A

United States Patent [19]

Kohara et al.

[11] Patent Number: 5,387,361

[45] Date of Patent: Feb. 7, 1995

[54] ETCHING LIQUID FOR ALUMINIUM, METHOD OF ETCHING ALUMINIUM AND ETCHED ALUMINIUM PRODUCT

[75] Inventors: Ichiro Kohara; Masakatu Takaishi, both of Nara; Hideaki Ishitobi, Yamatokoriyama; Kiyoshi Kondo, Itami; Hiroya Ito, Osaka, all of Japan

[73] Assignees: Sharp Kabushiki Kaisha; Oogi Chemical Industry Co., Ltd., both of Osaka, Japan

[21] Appl. No.: 956,968

[22] Filed: Oct. 6, 1992

[30] Foreign Application Priority Data

Oct. 9, 1991 [JP] Japan ..... 3-290646

[51] Int. Cl.[6] ..... H01L 21/00

[52] U.S. Cl. ..... 252/79.1; 252/79.2; 252/79.3; 252/79.4; 156/664; 156/665; 156/637

[58] Field of Search ..... 252/79.1, 79.2, 79.3, 252/79.4; 156/664, 665, 637

[56] References Cited

U.S. PATENT DOCUMENTS 4,459,216 7/1984 Nakazato ..... 252/79.4
4,886,920 12/1989 Cantrell ..... 570/141

FOREIGN PATENT DOCUMENTS 0397327 11/1990 European Pat. Off. .
48-092230 11/1973 Japan .
48-093542 12/1973 Japan .
63-054332 3/1988 Japan .

*Primary Examiner*—R. Bruce Breneman
*Assistant Examiner*—George Goudreau
*Attorney, Agent, or Firm*—Armstrong, Westerman, Hattori, McLeland & Naughton

[57] ABSTRACT

Aluminum is etched with an etching liquid comprising an aqueous solution containing a hydrofluoride of an aliphatic primary, secondary or tertiary amine of a formula:

$$R_1—N(R_3)—R_2$$

where $R_1$, $R_2$ and $R_3$ each represent H or an alkyl group, provided that at least one of $R_1$, $R_2$ and $R_3$ is an alkyl group and that the total of carbon atoms in $R_1$, $R_2$ and $R_3$ is 12 or less, and an oxidizing agent, to form a fine etched pattern which is not inferior to a pattern to be formed by copper etching.

6 Claims, 2 Drawing Sheets

ETCHING LIQUID FOR ALUMINIUM, METHOD OF ETCHING ALUMINIUM AND ETCHED ALUMINIUM PRODUCT

FIELD OF THE INVENTION

The present invention relates to an etching liquid for aluminium, a method of etching aluminium with the etching liquid, and an etched aluminium product as produced with the etching liquid and the etching method. More precisely, it relates to an etching liquid for aluminium and a method of etching aluminium with the etching liquid, which are usable for inexpensive, stable and industrial production of fine aluminium etched patterns, such as printed circuit plates as used much in various electronic instruments and others in these days, and also to etched aluminium products with fine etched patterns, such as the above-mentioned printed circuit plates and others.

BACKGROUND OF THE INVENTION

Printed circuit plates which are used much in various electronic instruments in these days are mostly produced by a so-called subtractive process, in which a metal leaf is laminated on the surface of an insulator base of a soft base, such as flexible polyester film or polyimide film, or of a hard base, such a paper-phenol base or a glass-epoxy base, then an etching resist coated film is formed on the surface of the metal leaf on the base by a screen printing method or a photo-processing method, and thereafter the unnecessary metal leaf in the non-resist area is dissolved and removed with an etching liquid to give a desired pattern on the base.

As the metal leaf to be on the surface of the base, mostly used at present is copper. However, aluminium has become used partly, because of the reasons that it has a lighter weight than copper, that it has excellent flexibility, that it has excellent corrosion resistance even under no corrosion-resistant treatment such as metal plating and that it is inexpensive.

Heretofore, as an etching liquid for aluminium, an aqueous solution of a metal chloride such as ferric chloride or cupric chloride, or an inorganic acid such as hydrochloric acid or phosphoric acid, or an aqueous solution of an inorganic alkali substance such as sodium hydroxide has been used. Of them, an aqueous solution of ferric chloride is used most popularly; and a concentrated phosphoric acid or an etching liquid essentially consisting of it is used for obtaining finer patterns.

However, where aluminium is etched with the above-mentioned conventional etching liquid, there occur various problems that too much under-cutting causes extremely thin lines of etched patterns and that too extremely rough edges of etched pattern lines cause much cutting of the lines. In addition, where a rolled aluminium leaf is used, since the leaf involves orientation of the crystal lattice configuration of the aluminium metal due to stretching during manufacture of the leaf, there occur still other problems that the etched condition differs in the pattern in the direction parallel to the stretched direction and in the pattern in the direction perpendicular to it and that damage of the resist coat film or adhesion failure of the film during etching gives defective patterns with lost areas. Where etching is effected with the conventional etching liquid, the edges and walls of the etched patterns would have large and small projections and depressions to be porous, in which the adhered etching liquid or halogens or other harmful ions to be contained in the materials to be used in the etching and other steps would remain therein as they are, without being completely removed in the successive washing step, and the remained components would accelerate corrosion of aluminium and would cause other various troubles. In particular, where printed circuit plates as produced by such conventional etching are combined into electronic instruments as LSI or the like, they would cause various troubles of the electronic instruments.

The above-mentioned drawbacks of conventional etching are not only in etching of aluminium but also in etching of copper, but the frequency of them is much more in the former than in the latter. The reasons are considered to be because of the obstructions specific to aluminium, such as the presence of an oxide layer of aluminium, the formation of local cells during etching and additionally the generation of hydrogen during etching.

Regarding the presence of the oxide layer of aluminium mentioned above, aluminium is naturally oxidized extremely with ease so that the surface of an aluminium leaf is to have an aluminium oxide layer thereon. The aluminium oxide layer on the surface of the leaf has a much lower dissolution rate by etching than the metal aluminium in the inside thereof. In producing printed circuit plates, the oxide layer on the surface of the aluminium leaf is generally removed by physical or chemical treatment prior to etching, but removal of the back side oxide layer as adhered to the insulator base is impossible by the treatment. Accordingly, as shown in FIG. 1, much time is needed for dissolution of the back side oxide layer in the terminal stage of etching, whereupon dissolution of the metal aluminium of both sides progresses much. It is considered that this would cause great under-cutting by etching to result in formation of noticeably thinned lines.

Next, regarding the formation of local cells during etching, aluminium having a lower standard electrode potential (or having a higher ionization tendency) than hydrogen generates much hydrogen during etching of it when it is dissolved in an etching liquid of an acid, alkali or chloride. This is because a metal aluminium having a high ionization tendency is ionized and dissolved whereby $H^+$ is reduced to be $H_2$. Thus, the etching mechanism of aluminium is different from that of copper having a low ionization tendency in this point. In the case of etching aluminium under such mechanism, where aluminium is brought into contact with a metal having a lower ionization tendency than it, it forms local cells to accelerate the ionization of itself much more, or that is, the aluminium becomes more soluble in the etching liquid. Accordingly, for example, where an aqueous solution of ferric chloride is used as an etching liquid in the case, the aluminium having a higher ionization tendency is ionized and dissolved, while the ferric ion is deionized to give an iron precipitate. Where the precipitated iron adheres to the surface of the aluminium, as shown in FIG. 2, it forms a local cell to further promote the dissolution rate of the adjacent aluminium. As a result, the aluminium is not dissolved at a uniform rate as a whole but is dissolved unevenly to give rough projections and depressions on the edges of the lines of the etched patterns or on the walls of them, as shown in FIG. 3, so that the etched pattern lines are to have extremely thinned areas and would be cut in some places.

An ordinary aluminium leaf contains, as impurities, metals having a low ionization potency, such as iron, silicon or copper. Therefore, formation of such local cells would occur not only in etching aluminium with an etching liquid containing a metal of a different kind such as ferric chloride or cupric chloride but also in the same with an etching liquid not containing a metal of a different kind such as hydrochloric acid or phosphoric acid. In addition, since such metals of impurities are not uniformly in an aluminium leaf but are locally around the crystal lattice of the aluminium metal, only the aluminium adjacent to the localized impurities is dissolved more rapidly so that dissolution of the aluminium is to be uneven. Further, the metals of impurities which have been dissolved would repeat the precipitation and dissolution, like the above-mentioned ferric chloride, to be seeds of forming local cells. It is said that formation of the local cells to cause the etching failure would occur not only by the use of metals of different kinds in etching but also due to the disorder of the crystal lattice configuration of the aluminium metal to be etched.

Regarding the obstruction due to generation of hydrogen, when aluminium is etched, a large amount of hydrogen is generated irrespective of the acid or alkaline etching liquid to be used, and the hydrogen gas has a peeling power to damage the edges of the resist coat film or bubbles of the gas temporarily adhere to the surface of the aluminium to prevent the surface from being in contact with the etching liquid. Thus, the generated hydrogen causes etching failure.

SUMMARY OF THE INVENTION

As mentioned above, the conventional means of etching aluminium have various obstructions and the factors of obstructions are often combined. Therefore, in accordance with the conventional etching means, it is difficult to produce fine patterns. For instance, in etching of an aluminium leaf having a thickness of 8 μm or more, which is generally used in producing printed circuit plates, the limit of the pattern to be etched is about 1.0 mm pitch when an aqueous ferric chloride solution is used and is about 0.2 mm pitch when a concentrated phosphoric acid is used. Because of the reasons, etching of aluminium has heretofore been applied to limited uses. However, if aluminium could be etched to give a fine pattern which is not inferior to or is comparable to that to be formed from copper, it is expected that the intrinsic characteristics of aluminium could be fully utilized to greatly enlarge the scope of the use of etched aluminium products.

Under the situation, the object of the present invention is to provide a novel etching liquid for aluminium and a novel method of etching aluminium with the liquid to give fine etched patterns which are not inferior to those to be obtained from copper, whereby the scope of the use of etched aluminium products is enlarged. The object has been attained by a novel etching liquid for aluminium, which comprises an amine hydrofluoride and an oxidizing agent.

DETAILED DESCRIPTION OF THE INVENTION

Figure 1:
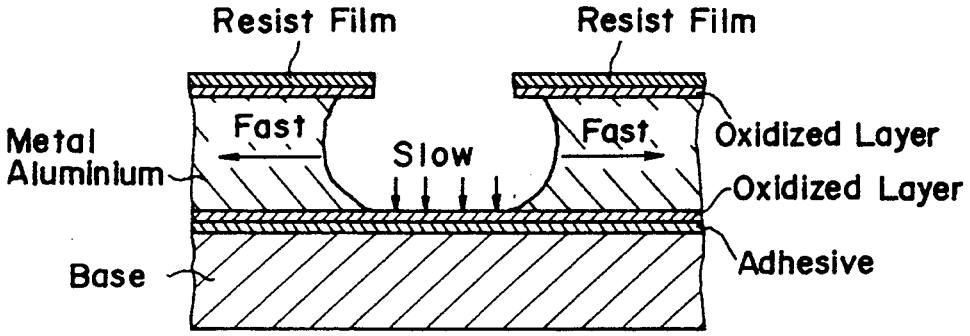
FIG. 1 is a cross-sectional explanatory view of showing the condition of the final stage of conventional aluminium etching.
Figure 2:
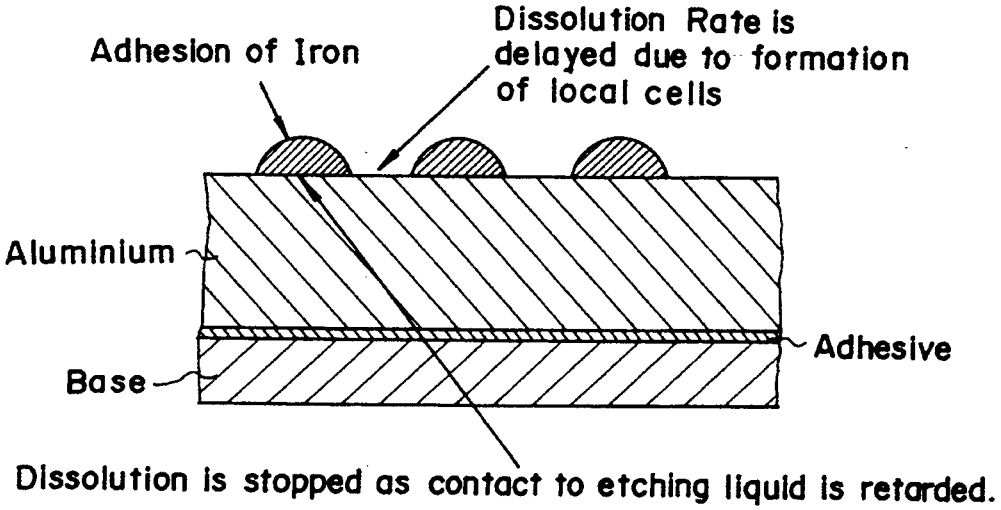
FIG. 2 is a cross-sectional explanatory view of showing the condition of causing difference in the etching rate due to adhesion of a metal of a different kind to aluminium in conventional aluminium etching.

In accordance with the present invention of etching aluminium with an etching liquid of an aqueous solution containing an amine hydrofluoride and an oxidizing agent, aluminium is first oxidized with the oxidizing agent to be converted into an aluminium oxide, which is then dissolved by the amine hydrofluoride. Thus, in the etching process to be effected with the etching liquid of the present invention, the metal aluminium is not directly ionized to be dissolved like the dissolution by a conventional etching liquid, but it is first converted into an aluminium oxide and then the oxide is dissolved. Therefore, the etching process of the present invention is free from the obstruction to be caused by formation of local cells, which is inevitable in conventional etching. In addition, since no hydrogen gas is generated during etching with the etching liquid of the present invention, the etching process of the present invention is also free from the obstruction to be caused by hydrogen gas. Thus, during etching with the etching liquid of the present invention, dissolution of aluminium progresses at a uniform rate on the whole surface of the aluminium leaf throughout the etching process so that the edges and walls of the etched patterns have neither projections nor depressions and have neither extremely thinned lines nor cut lines.

In the system of using the etching liquid of the present invention, since the dissolution rate of the aluminium oxide formed is one as controlled by the etching rate, dissolution of the oxide layer to be initially on the back surface of the aluminium leaf also progresses at a constant rate as a whole of the aluminium leaf, not being differentiated from the other part of the leaf. Therefore, the system is free from any excess undercutting of the sides of the etched pattern during dissolution of the oxide layer, which is the last hardly soluble layer, being different from the case of using a conventional etching liquid. Thus, in accordance with the etching system of the present invention, etching may be finished with little under-cutting.

The reason why an amine hydrofluoride is used for dissolving the aluminium oxide in the above-mentioned case is because the aqueous solution of the salt may dissolve the aluminium oxide to be formed by oxidation of aluminium metal with an oxidizing agent at a suitable rate. Hydrofluoric acid of itself may dissolve the aluminium oxide, but it has a too high dissolution rate so that it would directly dissolve the aluminium metal, before the metal is oxidized to be an aluminium oxide, to vigorously generate hydrogen and therefore the intended object could not be attained.

The amine moiety to constitute the amine hydrofluoride for use in the present invention is not specifically limited, provided that it does not have any other acid group or basic group than amino group, such as —COOH or —$SO_3H$, and that it is soluble in water in an amount of 0.1 mol/liter or more. As specific examples of the amine, mentioned are aliphatic primary, secondary or tertiary amines of a general formula:

$R_1—N(R_3)—R_2$ where $R_1$, $R_2$ and $R_3$ each represent H or an alkyl group, provided that at least one of $R_1$, $R_2$ and $R_3$ is an alkyl group and that the total of the carbon atoms in $R_1$, $R_2$ and $R_3$ is 12 or less.

The alkyl group of $R_1$, $R_2$ or $R_3$ may have one or more substituents and unsaturated groups, such as —OH, —Cl, —Br, —CN, ester groups and aromatic rings.

As amines of the kind, for example, there are mentioned primary amines such as methylamine, ethylamine, propylamine, butylamine, hydroxyethylamine, chloroethylamine and ethylbenzylamine; secondary amines such as dimethylamine, diethylamine, dipropylamine, methylethylamine and methylbenzylamine; and tertiary amines such as trimethylamine, triethylamine, tripropylamine, dimethylethylamine, methyldiethylamine and benzyldimethylamine.

Further mentioned are aliphatic diamines of a formula:

$H_2N—(CH_2)_n—NH_2$ where $(CH_2)_n$ means a linear or branched chain with n being 8 or less. Examples of them are ethylenediamine, 1,3-diaminopropane, 1,4-diaminobutane and hexamethylenediamine.

Also mentioned are aliphatic polyamines of:

$H_2N—(CH_2)_m—NH—(CH_2)_n—NH_2$, $H_2N[(CH_2)_2NH]_m(CH_2)_nNH_2$, and $[CH_3(CH_2)_m]_2N(CH_2)_nNH_2$.

where $(CH_2)_m$ means a linear or branched chain with m being 8 or less.

Also mentioned are heterocyclic amines such as pyridine, picoline, pyrrole, pyrrolidine and N-methylpiperidine.

A salt of such an amine and hydrofluoric acid may be produced by general neutralization reaction of them in an aqueous solution. If desired, an already prepared salt of them may be dissolved in water. The pH value of the etching liquid of the present invention is adjusted to fall within the range of from 4 to 9. If it is lower than 4, hydrofluoric acid would directly dissolve the metal aluminium to have a bad influence on the condition of the finish of the etched product or would worsen the durability of the etching resist coat film to cause various obstructions of breakage or peeling of the resist coat film during the course of etching. On the contrary, if the pH value is higher than 9, the etching liquid would rapidly decompose the oxidizing agent to thereby worsen the stability of the liquid.

Concretely, the above-mentioned etching liquid consists essentially of an aqueous solution containing from 0.1 to 15 mol/liter of an amine hydrofluoride and from 0.02 to 10 mol/liter of an oxidizing agent. The concentration of the amine hydrofluoride in the liquid merely participates in the etching rate but not in the condition of the finish of etching. Practically, it is desired to fall within the range of from 0.1 to 15 mol/liter as mentioned above, more preferably approximately from 2 to 6 mol/liter.

The oxidizing agent to be incorporated into the etching liquid of the present invention may be anyone which satisfies the conditions that it may well oxidize a metal aluminium, that it is neutral and that it is stable in the etching liquid composition. As such an oxidizing agent, usable are inorganic peroxides such as hydrogen peroxide and sodium perchlorate and organic peroxides such as t-butylhydroperoxide and benzoyl peroxide. Also usable is to feed ozone as generated in an ozonizer to the etching liquid as an oxidizing agent. Practically and economically, hydrogen peroxide is most advantageous. The lowermost limit of the amount of the oxidizing agent to be in the etching liquid is such that etching of aluminium with the liquid may progress without generation of hydrogen. For instance, when hydrogen peroxide is used, the amount thereof is practically from 0.02 to 10 mol/liter as mentioned above, and more preferably, it is approximately from 0.5 to 3 mol/liter.

The etching liquid of the present invention may optionally contain, in addition to the essential component of the above-mentioned amine hydrofluoride and oxidizing agent, other additives such as surfactant, defoaming agent, stabilizer, etc., if desired.

The method of etching aluminium of the present invention uses the above-mentioned etching liquid, which method may apply to any and every wet etching system as currently employed in this technical field, such as dip-etching, foam-etching, pour-etching or spray-etching.

Where printed circuit plates are produced in accordance with the present invention, any and every insulator base may be used irrespective of the kind of the material thereof, including, for example, soft bases such as polyester film and polyimide film, and hard bases such as paper-phenol base and glass-epoxy base. Aluminium is laminated on the surface of the base, and it may be any and every one in the form of a rolled leaf, a vapor-deposited leaf and a sheet. The manufacture method and the shape of the aluminium leaf are not limited. The etching temperature participates in the etching rate. If it is too low, the etching rate would be slow, while if it is too high, the rate would be rapid. Suitably, etching is effected at a temperature within the range of from 30° to 60° C. in accordance with the present invention.

The pH value of the etching liquid rises due to fatigue thereof after progress of etching with it, whereby the etching rate is lowered. In order to prevent this, an aqueous hydrofluoric acid solution is supplemented to the etching liquid as being used whenever necessary during etching so that the pH value of the liquid is kept to fall within the range of from 5 to 7. By such supplement of hydrofluoric acid to the etching liquid so as to prevent the pH value of the liquid from rising and to keep the etching rate constant, industrial continuous etching is possible and the life of the etching liquid being used is noticeably prolonged, economically advantageously.

By etching of aluminium with the etching liquid of the present invention as mentioned above, etching failure of conventional aluminium etching to be caused by the presence of an oxidized layer, formation of local cells and generation of $H_2$ may be evaded. In addition, in accordance with the present invention, the aluminium surface is pre-treated by polishing followed by treatment with the etching liquid or a diluted liquid thereof, prior to coating of a resist thereon.

Mechanical polishing of the surface of a metal prior to coating of an etching resist thereon is generally effected also as pre-treatment of a copper leaf. In accordance with the present invention, however, the aluminium surface is mechanically polished and additionally pre-treated with the etching liquid or a diluted liquid thereof, whereby the thus treated aluminium may have good adhesion to the resist coat film to be coated thereover.

In general, where a rolled aluminium is etched, the pattern in the direction parallel to the stretched direction is finished to be extremely even, but the pattern in the direction perpendicular to the same often has wedge-like pattern defects. In addition, the oil residues and stretched scratches to result from stretching of aluminium, as well as oil pits and organic contaminants on the aluminium surface lower the adhesion power between the resist coat film and the aluminium, whereby the etching liquid as applied thereto would penetrate into the aluminium base to cause formation of pattern defects. Aluminium is naturally oxidized with ease to form an oxidized film in air with ease. However, after the oxidized film has been formed once, further oxidation of the aluminium base hardly progresses. Therefore, the surface of an aluminium leaf as produced through such an oxidation step has uneven thickness and quality of the oxidized film as formed thereon.

Therefore, in accordance with the present invention, the surface of the aluminium leaf is polished as mentioned above to remove the formed aluminium oxide film and organic impurities therefrom and thereafter the whole surface of the aluminium is pre-etched with a diluted liquid of the etching liquid. By the pre-treatment, the oxide film as being originally on the surface of the aluminium is completely removed so that the pure aluminium base is exposed to air, whereupon a fresh oxide film is newly formed instantaneously thereon. The new oxide film is different from one as originally being on the surface of the aluminium before surface polishing, and it is an even oxide film as formed uniformly on the whole surface of the aluminium. It may well adhere to the resist coat film. Accordingly, generation of the difference in the finally etched condition between the pattern in the direction parallel to the stretched direction and that in the direction perpendicular to the same to be caused by orientation of the crystal lattice configuration of the aluminium metal may surely be prevented, and additionally, any other failure causing factors of worsening the finish of the finally etched condition, such as oil residues, oil pits and organic contaminants to be formed on the surface of the rolled aluminium base during stretching of it, may also be eliminated.

As mentioned above, by using the etching liquid for aluminium of the present invention as well as the method of etching aluminium with the liquid, various defects which have heretofore been troublesome in the case of using conventional etching liquid and etching method, such as decrease of the line width of etched patterns due to under-cutting, breakage or cutting of lines of etched patterns due to roughness of the edges of the lines with projections and depressions formed, drop of lines of etched patterns due to damage or adhesion insufficiency of the resist coat film during etching, and other various obstructions in formation of fine patterns by aluminium etching may be overcome and eliminated. As a result, in accordance with the present invention, fine etched patterns of 0.1 mm pitch or less may stably be produced in an industrial scale to yield aluminium-etched printed circuit plates which are inexpensive and have high reliability.

Where etching of aluminium is effected with a conventional etching liquid, the edges and walls of the etched patterns would have large and small projections and depressions to be porous, in which the adhered etching liquid or halogens or other harmful ions to be contained in the materials to be used in the etching and other steps would remain therein as they are, without being completely removed in the successive washing step, and the remained components would accelerate corrosion of aluminium and would cause other various troubles. As opposed to the case of using such a conventional etching liquid, the etched products as produced in accordance with the present invention have extremely even edges and walls of the patterns so that the harmful ions derived from the etching liquid and other materials as used in other steps may easily and completely be removed off by washing. As a result, the products may display 100% corrosion resistance intrinsic to the aluminium metal.

The aluminium etching liquid and the etching method of the present invention are especially advantageously utilized in production of printed circuit plates which are much used in various electronic instruments, as mentioned above. In addition, they may also apply to production of other etched aluminium products which need fine etching operation, such as offset printing plates and various decorations and accessories.

The present invention will be explained in more detail by way of the following examples and comparative examples, which, however, are not intended to restrict the scope of the present invention.

EXAMPLE 1

A base formed by laminating an aluminium leaf having a thickness of 15 μm on a polyester film having a thickness of 50 μm was used. First, the aluminium surface of the base was mechanically polished and the base was then dipped in a 1/20 diluted liquid of the etching liquid shown in Table 1 below, at 40° C. for 2 minutes. After washed with water, this was dried. A positive photo resist was applied to the base to form a resist coat film of a 0.1 mm pitch pattern figure thereon. This was used as an etching sample. The etching sample was dipped in the etching liquid of Table 1 below as kept at 40° C., whereupon the aluminium was dissolved without generation of hydrogen. In 12 minutes, all the aluminium in the non-resist area disappeared, and an aluminium-etched printed circuit plate was obtained.

Figure 4:
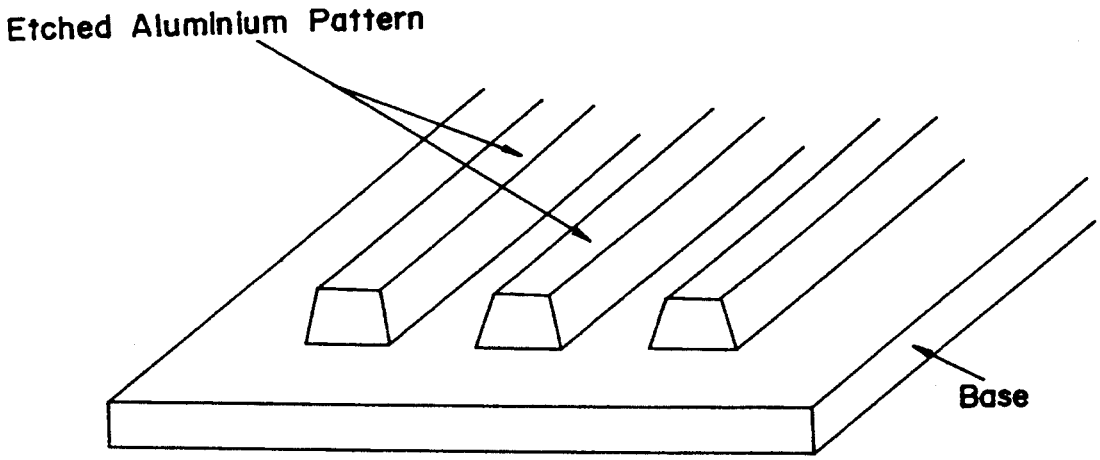
FIG. 4 is an enlarged perspective view of showing an etched aluminium pattern formed in accordance with the present invention (Example 1).

The finished condition of the etched circuit was good even in the fine lines of 0.1 mm pitch, without any extremely thin lines or broken lines, irrespective of the stretched direction of the aluminium leaf. The edges and walls of the patterns were extremely even, with neither projections nor depressions. (Refer to FIG. 4.)

TABLE 1

| | |
|---|---|
| Water (ml) | 1000 |
| 55% HF (g) | 180 |
| 35% $H_2O_2$ (g) | 150 |
| $(C_2H_5)_2NH$ (g) | 360 |
| pH of Etching Liquid | 7.0 |

EXAMPLE 2

The etching sample as pre-treated and formed in the same manner as in Example 1 was dipped in the etching liquid of Table 2 below at 50° C., whereupon etching of the sample was finished in 14 minutes. The thus obtained etched circuit was good, like that obtained in Example 1.

TABLE 2

| | |
|---|---|
| Water (ml) | 1000 |
| 55% HF (g) | 180 |
| 35% $H_2O_2$ (g) | 150 |
| 70% $C_2H_5NH_2$ (g) | 320 |
| pH of Etching Liquid | 6.7 |

EXAMPLE 3

The etching sample as pre-treated and formed in the same manner as in Example 1 was dipped in the etching liquid of Table 3 below at 40° C., whereupon etching of the sample was finished in 12 minutes. The thus obtained etched circuit was good, like that obtained in Example 1.

TABLE 3

| | |
|---|---|
| Water (ml) | 1000 |
| 55% HF (g) | 180 |
| 35% $H_2O_2$ (g) | 150 |
| $(C_2H_5)_3N$ (g) | 500 |
| pH of Etching Liquid | 6.8 |

EXAMPLE 4

The etching sample as pre-treated and formed in the same manner as in Example 1 was dipped in the etching liquid of Table 4 below at 40° C., whereupon etching of the sample was finished in 8 minutes. The thus obtained etched circuit was good, like that obtained in Example 1.

TABLE 4

| | |
|---|---|
| Water (ml) | 1000 |
| 55% HF (g) | 180 |
| 35% $H_2O_2$ (g) | 150 |
| $H_2NCH_2CH_2NH_2$ (g) | 170 |
| pH of Etching Liquid | 9.0 |

EXAMPLE 5

The etching sample as pre-treated and formed in the same manner as in Example 1 was dipped in the etching liquid of Table 5 below at 40° C., whereupon etching of the sample was finished in 6 minutes. The thus obtained etched circuit was good, like that obtained in Example 1.

TABLE 5

| | |
|---|---|
| Water (ml) | 1000 |
| 55% HF (g) | 180 |
| 35% $H_2O_2$ (g) | 150 |
| $H_2NCH_2CH_2NH_2$ (g) | 150 |
| pH of Etching Liquid | 7.2 |

EXAMPLE 6

The etching sample as pre-treated and formed in the same manner as in Example 1 was dipped in the etching liquid of Table 6 below at 40° C., whereupon etching of the sample was finished in 4 minutes. The thus obtained etched circuit was good, like that obtained in Example 1.

TABLE 6

| | |
|---|---|
| Water (ml) | 1000 |
| 55% HF (g) | 180 |
| 35% $H_2O_2$ (g) | 150 |
| $H_2NCH_2CH_2NH_2$ (g) | 120 |

TABLE 6-continued

| | |
|---|---|
| pH of Etching Liquid | 4.0 |

The above-mentioned Examples 4 to 6 demonstrate embodiments different from one another in the proportion of hydrofluoric acid and amine and in the pH value of the etching liquid as varying within the range of from 4.0 to 9.0. As is obvious from them, the condition of all the finally etched circuit products was good within the above-mentioned pH range of the etching liquid used, except that the time necessary for etching varied in each case.

EXAMPLE 7

The etching sample as pre-treated and formed in the same manner as in Example 1 was dipped in the etching liquid of Table 7 below at 50° C., whereupon etching of the sample was finished in 5 minutes. The thus obtained etched circuit was good, like that obtained in Example 1.

TABLE 7

| | |
|---|---|
| Water (ml) | 1000 |
| 55% HF (g) | 180 |
| 35% $H_2O_2$ (g) | 150 |
| $(H_2NCH_2CH_2)_2NH$ (g) | 170 |
| pH of Etching Liquid | 6.5 |

EXAMPLE 8

The etching sample as pre-treated and formed in the same manner as in Example 1 was dipped in the etching liquid of Table 8 below at 40° C., whereupon etching of the sample was finished in 5 minutes. The thus obtained etched circuit was good, like that obtained in Example 1.

TABLE 8

| | |
|---|---|
| Water (ml) | 1000 |
| 55% HF (g) | 180 |
| 35% $H_2O_2$ (g) | 150 |
| Pyridine (g) | 390 |
| pH of Etching Liquid | 7.0 |

COMPARATIVE EXAMPLE 1

Using the same etching liquid as that in Example 1, except that the amine was replaced by 300 g of 28% aqueous ammonia and that the pH value of the etching liquid was adjusted to be 7, the same process as in Example 1 was repeated. Even after the base was dipped in the etching liquid for one hour at 50° C., the aluminium was not dissolved. From the result, it is obvious that the amine is indispensable as a neutralizing agent of the etching liquid.

COMPARATIVE EXAMPLE 2

Using the same etching liquid as that in Example 1, except that the amine was replaced by 460 g of aniline and that the pH value of the etching liquid was adjusted to be 6, the same process as in Example 1 was repeated. Even after the base was dipped in the etching liquid for one hour at 50° C., the aluminium was not dissolved. From the result, it is obvious that the aromatic amine is unsuitable to the etching liquid of the present invention.

COMPARATIVE EXAMPLE 3

Using the same etching liquid as that in Example 4, except that the amount of the ethylenediamine was increased to adjust the pH value of the liquid to be 9.5, the same process as in Example 4 was repeated. The finished condition of the finally etched circuit was good, but the time necessary for etching was much over 15 minutes. In addition, the stability of hydrogen peroxide in the etching liquid was bad to be decomposed gradually even at room temperature, and the amount of hydrogen peroxide in the liquid decreased to less than a half of the original amount thereof in a day. Therefore, a higher pH value of the etching liquid than 9 is unfavorable, since not only the time necessary for etching with it is prolonged but also the stability of the etching liquid is worsened.

COMPARATIVE EXAMPLE 4

Using the same etching liquid as that in Example 6, except that the amount of the ethylenediamine was decreased to adjust the pH value of the liquid to be 3, the same process as in Example 6 was repeated. Etching was finished in 2 minutes and 30 seconds. However, hydrogen was generated vigorously during etching. In addition, the etched circuit thus obtained involved serious under-cutting and had many projections and depressions on the rough edges of the formed lines, and fine patterns having a line width of 0.1 mm or less were all lost. Further, the resist coat film was partly lifted up or peeled off from the base due to adhesion insufficiency of the film to the base.

As in the above-mentioned Comparative Examples 3 and 4, where the pH value of the etching liquid oversteps the suitable range, the stability of the etching liquid is worsened and the patterns formed involve undercutting and have rough projections and depressions on the etched edges. As a result, the intended etching of the present invention could not be attained in the embodiments of Comparative Examples 3 and 4. They involve a serious bar to industrial scale production of etched product.

COMPARATIVE EXAMPLE 5

The same etching sample as that used in Example 1 was dipped in an aqueous 30% solution of ferric chloride at 40° C., whereupon etching was finished in 30 minutes and 30 seconds. However, the etched circuit thus obtained involved serious under-cutting and had many projections and depressions on the rough edges of the formed lines, and patterns having a line width of 0.3 mm or less were partly cut and patterns having a line width of 0.1 mm or less were all lost.

COMPARATIVE EXAMPLE 6

Figure 3:
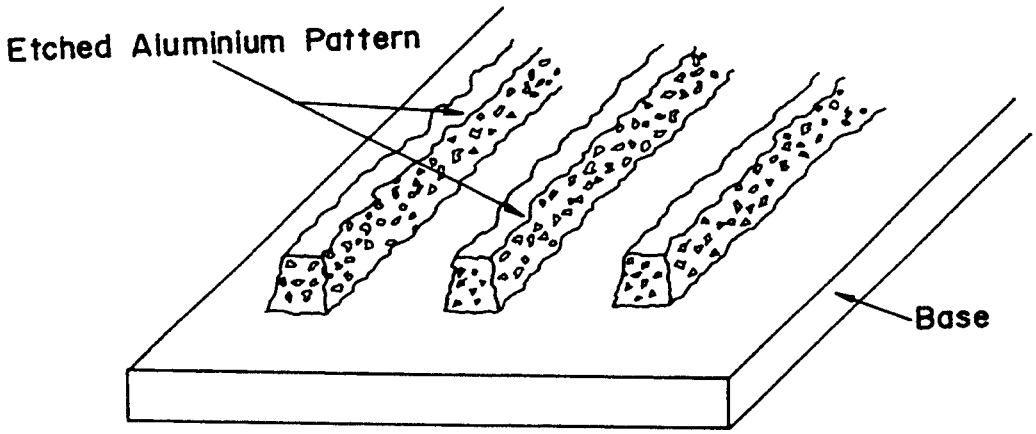
FIG. 3 is a perspective view of showing the condition of the finish of etched lines as accompanied by formation of local cells in conventional aluminium etching.

The same etching sample as that used in Example 1 was dipped in 85% phosphoric acid at 60° C., whereupon etching was finished in 15 minutes. However, the etched circuit thus obtained involved serious under-cutting of the patterns in the direction perpendicular to the stretched direction of the aluminium leaf and had many projections and depressions on the rough edges of the formed lines. Some etched lines were partly cut. The walls of the etched patterns had many fine projections and depressions to be porous. (Refer to FIG. 3.)

While the invention has been described in detail and with reference to specific embodiments thereof, it will be apparent to one skilled in the art that various changes and modifications can be made therein without departing from the spirit and scope thereof.

What is claimed is:

1. An etching liquid for aluminium, comprising an aqueous solution containing (1) 0.1 to 15 mol/liter of acid consisting of an amine hydrofluoride and (2) 0.02 to 10 mol/liter of an oxidizing agent, wherein said amine is one of an aliphatic amine having 12 carbon atoms or less and a heterocyclic amine, said amine having no other acid group or basic group other than amino group, the etching liquid having a pH within the range from 4 to 9, wherein said oxidizing agent oxidizes aluminium into an aluminum oxide which is dissolved by said amine hydrofluoride.

2. The etching liquid for aluminium as claimed in claim 1, in which the amine is an aliphatic primary, secondary or tertiary amine of a formula:

$$R_1—N(R_3)—R_2$$

where $R_1$, $R_2$ and $R_3$ each represent H or an alkyl group, provided that at least one of $R_1$, $R_2$ and $R_3$ is an alkyl group and that the total of carbon atoms in $R_1$, $R_2$ and $R_3$ is 12 or less.

3. The etching liquid for aluminium as claimed in claim 1, in which the amine is an aliphatic diamine of a formula:

$$H_2N—(CH_2)_n—NH_2$$

where $(CH_2)_n$ is a linear or branched chain with n being 8 or less.

4. The etching liquid for aluminium as claimed in claim 1, in which the amine is an aliphatic polyamine of a formula:

$$H_2N—(CH_2)_m—NH—(CH_2)_n—NH_2,$$

$$H_2N[(CH_2)_2NH]_m(CH_2)_nNH_2, \text{ or}$$

$$[CH_3(CH_2)_m]_2N(CH_2)_nNH_2.$$

where $(CH_2)_m$ and $(CH_2)_n$ are linear or branched chains with m and n being 8 or less.

5. The etching liquid for aluminium as claimed in claim 1, in which the amine is a heterocyclic amine of pyridines, pyrroles, pyrrolidines or piperidines.

6. The etching liquid for aluminium as claimed in claim 1, in which the oxidizing agent is hydrogen peroxide.

* * * * *